US005236369A

United States Patent [19]

Beach et al.

[11] Patent Number: 5,236,369

[45] Date of Patent: Aug. 17, 1993

[54] HOLDER FOR ELECTRICAL SAFETY CAPS

[76] Inventors: Sandra G. Beach; Michael D. Beach, both of 305 S. Bend Blvd., Steubenville, Ohio 43952

[21] Appl. No.: 924,196

[22] Filed: Aug. 3, 1992

[51] Int. Cl.[5] ..... H01R 13/44

[52] U.S. Cl. ..... 439/148; 174/67

[58] Field of Search ..... 439/135, 145, 148, 149; 174/67, 66

[56] References Cited

U.S. PATENT DOCUMENTS

| | | | |
|---|---|---|---|
| 3,389,367 | 1/1968 | Schwartz | 439/148 |
| 3,876,273 | 4/1975 | Schwartz | 439/148 |
| 4,293,173 | 10/1981 | Tricca | 439/148 |
| 4,408,813 | 10/1983 | Koehler | 439/148 |
| 4,801,271 | 1/1989 | Piper | 439/148 |
| 5,017,148 | 5/1991 | Buckshaw | 439/148 |

*Primary Examiner*—Larry I. Schwartz
*Assistant Examiner*—Hien D. Vu
*Attorney, Agent, or Firm*—Webb, Burden, Ziesenheim & Webb

[57] ABSTRACT

The present invention is a holder for an electrical outlet safety cap. The holder includes a body having a prong receiving device therein for receiving the prongs of the electrical outlet safety cap to hold the safety cap when the electrical outlet is being used. The prong receiving device is electrically insulated from the outlet's source of electrical power.

9 Claims, 2 Drawing Sheets

HOLDER FOR ELECTRICAL SAFETY CAPS

BACKGROUND OF THE INVENTION

1. Field of the Invention

This invention relates to a holder for electrical outlet safety caps.

2. Prior Art

Insulating safety caps, or shields, have long been utilized with electrical outlets to prevent injury, especially to children, when the outlet is not in use. Safety caps generally have two prongs which engage the sockets of an electrical outlet to anchor the cap to the outlet and seal the electrical outlet when not in use.

To utilize the electrical outlet, the safety cap is removed from the outlet and should be replaced after use. Heretofore, a common problem with such safety caps is finding a convenient place to store them during use of the electrical outlet. Often the user fails to remember to replace the safety cap after use of an electrical outlet, and then the effectiveness of the safety cap is lost since it is not shielding the outlet. Furthermore, with no place to store them, safety caps are often placed on the floor where they can become damaged by being stepped on, vacuumed up, or otherwise damaged. These lost or damaged safety caps cannot be replaced into the outlet and also become ineffective.

Occasionally, the cap is placed in a pocket of clothing, where it is forgotten and not replaced.

In an attempt to solve this problem, cords have been attached to the safety caps which couple the safety caps directly to the electrical outlet. This solution has not been widely accepted due to the unsightly appearance of the dangling cord. Consequently, the majority of safety caps utilized do not include a means for storage. The object of the present invention is to overcome the aforementioned drawbacks of the prior art.

SUMMARY OF THE INVENTION

The present invention provides a holder for a safety cap having a plurality of prongs which engage the sockets of an electrical outlet. The holder includes a body portion with a prong receiving device therein for receiving the prongs of the safety cap to hold the safety cap when the electrical outlet is being utilized. The prong receiving device is electrically insulated from the outlet's source of electrical power.

In a first embodiment of the present invention, a fastener is attached to the body for coupling the holder to an electrical cord, and the prong receiving device includes a pair of parallel, spaced slots formed in the body. The fastener can be made as a loop which includes a hook and loop type fastener such as, for example, a length of Velcro ® attached thereto.

In a second embodiment of the present invention, the body includes a plurality of electrical prongs on a first end which are adapted to engage the sockets of the outlet. A plurality of sockets are provided on an opposite side of the body and are electrically connected with the plurality of electrical prongs of the body. A prong receiving device is provided in the body and includes a pair of parallel, spaced slots extending into the body.

In a third embodiment of the present invention, the prong receiving device includes a pair of parallel, spaced notches on opposite sides of the body. A central hole extends lengthwise through the body to receive an electrical cord therethrough. The body portion may be formed integrally with an electrical plug, or the body may be formed as two separate halves which can be snapped onto the electrical cord remote from the plug.

Other objects and aspects of the present invention will become apparent with the description of the preferred embodiment in connection with the attached figures.

BRIEF DESCRIPTION OF THE PREFERRED EMBODIMENTS

Figure 1:
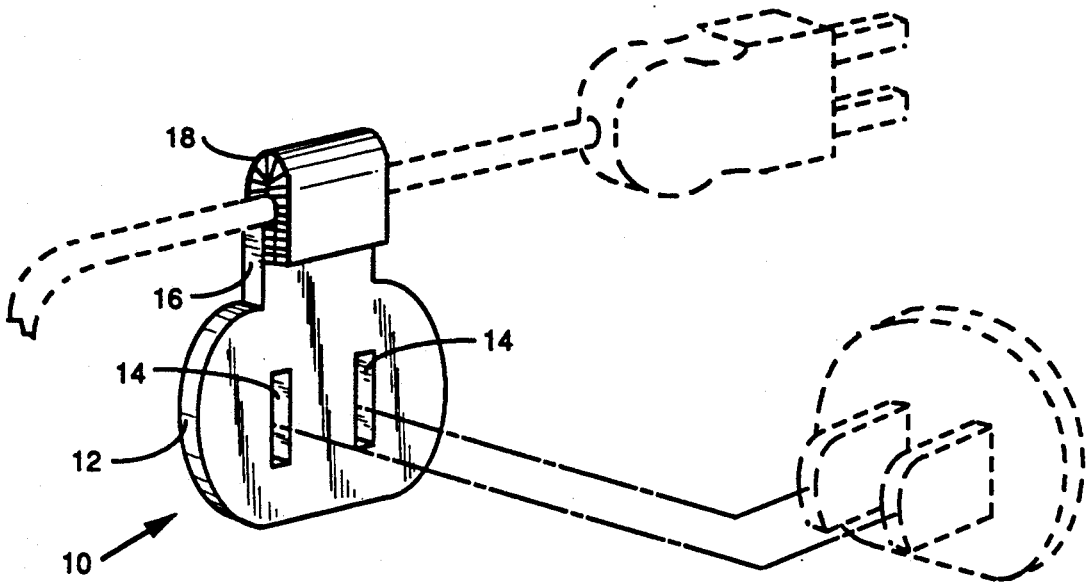
FIG. 1 is a perspective view of a first embodiment of the present invention.

FIG. 1 shows an outlet safety cap holder 10 which includes a flat, disc-shaped body 12. The body 12 includes a pair of parallel, spaced slots 14 extending therethrough which are adapted to receive the prongs of a safety cap (shown in phantom) to hold the safety cap when the electrical outlet is being utilized. The safety cap is held in the outlet safety cap holder 10 by friction between the slots 14 and the prongs of the safety cap. The slots 14 extend through the body 12 such that the safety cap may be inserted from either side of the body 12. A fastening strap 16 is attached to the body 12 and allows for connection of the outlet safety cap holder 10 to an electrical cord (shown in phantom). The fastening strap 16 includes a hook and loop type fastener 18, such as, for example Velcro ®, to provide for easy attachment of the cord. Other types of fasteners, such as, for example, snaps or buttons, may also be utilized.

In operation, the outlet safety cap holder 10 is attached to the electrical cord of an appliance or any electrical device. When the user utilizes the appliance, the presence of the outlet safety cap holder 10 on the electrical cord of the appliance will remind the user to attach the removed safety cap into the outlet safety cap holder 10. When the user is done with the outlet, the close proximity of the outlet safety cap holder to the plug will serve as a reminder to the user to replace the safety cap.

Figure 2:
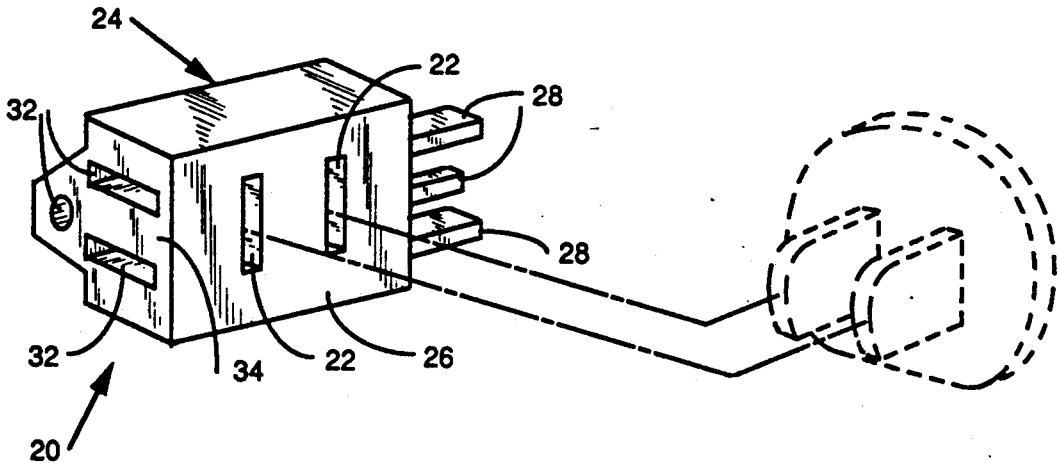
FIG. 2 is a perspective view of a second embodiment of the present invention.

FIG. 2 shows an outlet safety cap holder 20 which includes a pair of parallel, spaced slots 22 positioned in the body 24, on a top surface 26 thereof. The body 24 includes a plurality of electrical prongs 28 on an end surface 30 of the body 24. The electrical prongs 28 are adapted to engage the sockets of an electrical outlet (not shown) and are in electrical contact with a plurality of sockets 32 positioned on an opposite end 34 of the body 24. The sockets include a pair of parallel, spaced slots which are provided to be substantially orthogonal to the slots 22 which are adapted to receive the prongs of an outlet safety cap.

The body 24 is made of an electrically insulated material such that the slots 22 are electrically insulated from the sockets 32 and the electrical prongs 28. Any conventional electrically insulated material may be utilized for the body 24 such as, for example, rubber or plastic.

In use, the user installs the outlet safety cap holder 20 on the end of an appliance, or other electrical device, by inserting the prongs of the appliance's electrical plug into the sockets 32 of the body 24. When the appliance is utilized, the electrical outlet safety cap is removed from the outlet and can be inserted directly into the outlet safety cap holder 20 by inserting the prongs into the slots 22. The outlet safety cap 20 is held by frictional engagement between the slots 22 and the prongs of the safety cap. The close proximity of the safety cap holder 20 to the outlet will remind the user to replace the safety cap when finished. A conventional three-prong electrical connection is shown in the electrical outlet safety cap holder 20 in FIG. 2; however, it should be understood that a conventional two-prong plug may also be utilized with the present invention, as well as a three-prong adapter arrangement.

Figure 3B:
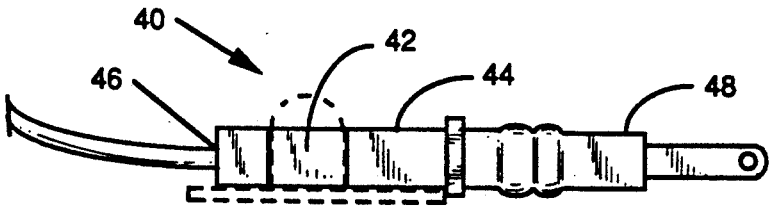
FIG. 3*b* is a side view of the electrical safety cap holder shown in FIG. 3*a*.
Figure 3A:
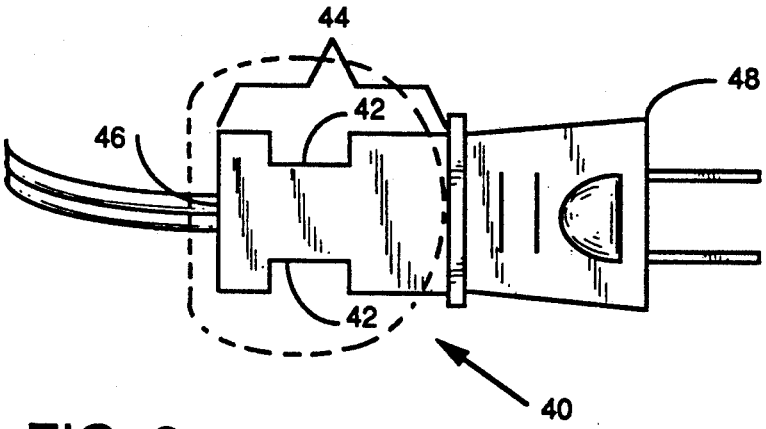
FIG. 3*a* is a top view of a third embodiment of the present invention.

FIG. 3*a* shows an outlet safety cap holder 40 which includes a pair of parallel, spaced notches 42 provided in a body 44. The notches 42 are provided on opposite sides of the body portion 44 and have a base portion which is substantially planar and extends across the body 44. The parallel, spaced notches 42 are positioned to receive the prongs of an outlet safety cap. Frictional engagement between the prongs of the safety cap and the notches 42 will hold the safety cap in position during use. The notches extend through the body 44 such that the electrical safety cap can be inserted from either side of the body 44. The body 44 includes a central hole 46 which extends lengthwise through the body 44 to accommodate an electrical cord. The outlet safety cap holder 40, shown in FIG. 3*a* and FIG. 3*b*, has a body 44 formed integrally with a conventional plug 48 of an electrical device. In operation, when the electrical device is used, the removed safety cap is inserted into the outlet safety cap holder 40. Since the body 44 is molded integrally with the electrical plug 48, the safety cap will always be in close proximity to the electrical outlet.

Figure 4:
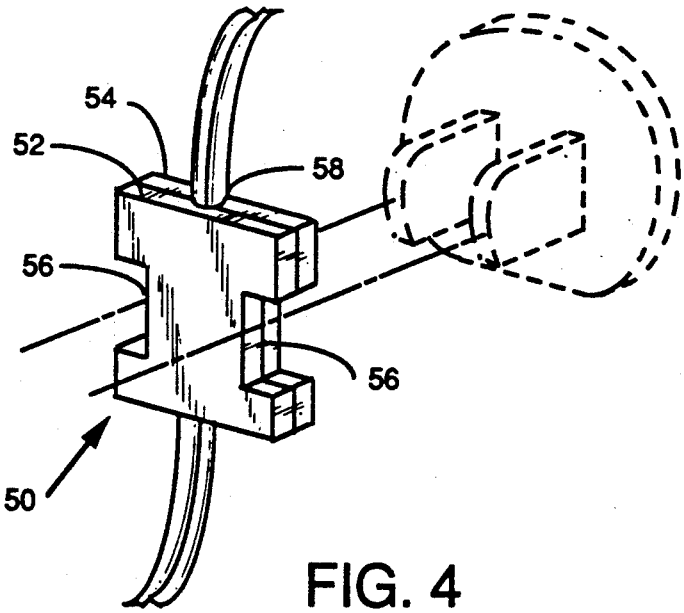
FIG. 4 is a perspective view of a modified electrical safety cap holder.

FIG. 4 shows an outlet safety cap holder 50 which includes a body which is divided into a first and second half 52 and 54, respectively. The body includes a pair of parallel, spaced notches 56 positioned on opposite sides of the body and extending therethrough. The notches 56 are positioned and adapted to receive the prongs of an outlet safety cap holder. Frictional engagement between the prongs of the safety cap and the notches 56 will hold the safety cap on the outlet safety cap holder 50. A central hole 58 extends longitudinally through the body and is adapted to receive an electrical cord (shown in phantom). The central hole 58 is positioned such that a portion of it is within both body halves 52 and 54. The two halves of the body portion, 52 and 54, are adapted to be snapped together or held together in any other conventional fashion. In operation, the outlet safety cap holder 50 is positioned on a cord by attaching the two body halves, 52 and 54, around an electrical cord. The outlet safety cap holder 50 operates in the same manner as the previous safety cap holders described above.

The bodies of the various outlet safety cap holders of the present invention may be made by a variety of materials such as, for example, plastic or rubber which serve to insulate the body's prong receiving device from the outlet's source of electrical power.

It should be apparent to those of ordinary skill in the art that various modifications may be had to the present invention without departing from the spirit and scope of the present invention. Therefore, the scope of the present invention is intended to be defined by the following claims.

What is claimed is:

1. A holder for holding a safety cap having a plurality of prongs, the prongs adapted to engage sockets of an electrical outlet with the outlet connected to a source of electrical power, wherein the safety cap must be removed from the electrical outlet when the electrical outlet is utilized; said holder comprising:

a body distinct from the electrical outlet having a prong receiving means therein which receives the prongs of a safety cap for holding the safety cap when the electrical outlet is being utilized and the safety cap has been removed from the electrical outlet, wherein said prong receiving means is electrically insulated from the source of electrical power; and a fastener means attached to said body for coupling said holder to a reference object.

2. The holder of claim 1 wherein said prong receiving means includes a pair of parallel, spaced slots.

3. The holder of claim 1 wherein said prong receiving means includes a pair of spaced notches on opposite sides of said body.

4. The holder of claim 3 further including a central hole extending lengthwise through said body and adapted to receive an electrical cord.

5. The holder of claim 3 wherein said body is formed as two separable halves.

6. The holder of claim 1 wherein said body is made of plastic.

7. The holder of claim 1 wherein said body is made of rubber.

8. The holder of claim 1 wherein said fastener means includes a strap with a hook and loop type fastener attached thereto.

9. The holder of claim 8 wherein said prong receiving means includes a pair of parallel, spaced slots which extend through said body.

* * * * *